US008523669B1

(12) United States Patent
Krietemeyer

(10) Patent No.: US 8,523,669 B1
(45) Date of Patent: Sep. 3, 2013

(54) METHOD OF ESTABLISHING OWNERSHIP OF A LOTTERY TICKET

(76) Inventor: Kevin D. Krietemeyer, Las Vegas, NV (US)

( * ) Notice: Subject to any disclaimer, the term of this patent is extended or adjusted under 35 U.S.C. 154(b) by 0 days.

(21) Appl. No.: 13/229,659

(22) Filed: Sep. 9, 2011

Related U.S. Application Data

(60) Provisional application No. 61/381,198, filed on Sep. 9, 2010.

(51) Int. Cl.
*A63F 9/00* (2006.01)

(52) U.S. Cl.
USPC ..... 463/29

(58) Field of Classification Search
None
See application file for complete search history.

(56) References Cited

U.S. PATENT DOCUMENTS

| | | | | |
|---|---|---|---|---|
| 4,832,341 | A * | 5/1989 | Muller et al. | 463/17 |
| 5,239,165 | A * | 8/1993 | Novak | 235/375 |
| 5,772,510 | A * | 6/1998 | Roberts | 463/17 |
| 6,277,026 | B1 * | 8/2001 | Archer | 463/42 |
| 6,322,446 | B1 * | 11/2001 | Yacenda | 463/16 |
| 6,666,768 | B1 | 12/2003 | Akers | |
| 6,869,358 | B2 | 3/2005 | Yacenda | |
| 6,905,411 | B2 | 6/2005 | Nguyen et al. | |
| 7,247,095 | B2 * | 7/2007 | Nulph | 463/17 |
| 7,294,056 | B2 | 11/2007 | Lowell et al. | |
| 7,303,468 | B2 | 12/2007 | Schneier et al. | |
| 7,527,556 | B2 | 5/2009 | Amada et al. | |
| 7,582,012 | B2 | 9/2009 | Walker et al. | |
| 7,662,038 | B2 * | 2/2010 | Bozeman | 463/17 |
| 7,677,453 | B2 * | 3/2010 | Chau | 235/443 |
| 7,716,126 | B2 | 5/2010 | France et al. | |
| 2002/0119817 | A1 * | 8/2002 | Behm et al. | 463/17 |
| 2006/0019736 | A1 * | 1/2006 | Amada | 463/17 |
| 2006/0035697 | A1 * | 2/2006 | Packes et al. | 463/17 |
| 2006/0079311 | A1 * | 4/2006 | Nulph | 463/17 |
| 2006/0154716 | A1 * | 7/2006 | Bozeman | 463/17 |
| 2007/0060285 | A1 * | 3/2007 | White et al. | 463/18 |
| 2007/0117609 | A1 * | 5/2007 | White et al. | 463/17 |
| 2007/0298860 | A1 * | 12/2007 | Graves et al. | 463/20 |
| 2008/0085763 | A1 * | 4/2008 | Randhawa | 463/25 |
| 2008/0167060 | A1 * | 7/2008 | Moshir et al. | 455/466 |
| 2009/0042631 | A1 * | 2/2009 | Randhawa | 463/17 |
| 2009/0093292 | A1 * | 4/2009 | Randhawa | 463/17 |
| 2009/0098923 | A1 * | 4/2009 | Randhawa | 463/17 |
| 2009/0280886 | A1 * | 11/2009 | Randhawa | 463/17 |
| 2010/0062824 | A1 * | 3/2010 | Frick et al. | 463/17 |
| 2010/0105462 | A1 | 4/2010 | Walker et al. | |
| 2011/0034230 | A1 * | 2/2011 | Guziel et al. | 463/17 |
| 2011/0159943 | A1 * | 6/2011 | Graves | 463/20 |
| 2011/0165933 | A1 * | 7/2011 | Guziel et al. | 463/17 |
| 2012/0244926 | A1 * | 9/2012 | Kolios et al. | 463/17 |

* cited by examiner

*Primary Examiner* — Melba Bumgarner
*Assistant Examiner* — Seng H Lim
(74) *Attorney, Agent, or Firm* — Dennis JM Donahue, III; CreatiVenture Law, LLC

(57) ABSTRACT

A personal play system and process are used to establish the ownership of a lottery game ticket and provide additional security and game options for lottery players. An authorized player accesses their user account in the system and creates a personalized game document. The personalized game document is scanned by a retail terminal's electronic scanner. The information is communicated to the lottery system's host computer which logs the information and verifies that the transaction can be completed by printing a personalized lottery ticket at the retailer terminal.

20 Claims, 5 Drawing Sheets

58

Example of a Current Prize Structure - Prize based on $1 Shares

| Price Point | $1 | $2 | $5 | $10 |
|---|---|---|---|---|
| Match | Prize | Prize | | |
| 3 | $ 25 | $ 50 | $ 125 | $ 250 |
| 2 | $ 2 | $ 4 | $ 10 | $ 20 |
| 1 | $ - | $ - | $ - | $ - |
| 0 | $ - | $ - | $ - | $ - |
| Payout % | 62.44% | 62.44% | 62.44% | 62.44% |

60

Example of a Graduated Prize Structure

| Price Point | $1 | $2 | $5 | $10 |
|---|---|---|---|---|
| Match | Prize | Prize | Prize | Prize |
| 3 | $ 23 | $ 50 | $ 135 | $ 250 |
| 2 | $ 2 | $ 4 | $ 10 | $ 25 |
| 1 | $ - | $ - | $ - | $ - |
| 0 | $ - | $ - | $ - | $ - |
| Payout % | 59.66% | 62.44% | 65.21% | 69.38% |

METHOD OF ESTABLISHING OWNERSHIP OF A LOTTERY TICKET

CROSS-REFERENCE TO RELATED APPLICATIONS

This application claims priority from U.S. Provisional Patent Application No. 61/381,198 filed on Sep. 9, 2010.

STATEMENT REGARDING FEDERALLY SPONSORED RESEARCH

Not Applicable.

APPENDIX

Not Applicable.

BACKGROUND OF THE INVENTION

1. Field of the Invention

This invention relates generally to lottery systems and more particularly to identifying the individual or group that has purchased a lottery ticket.

2. Related Art

Since the advent of the online lottery industry, the lottery game tickets have been anonymous, bearer instruments. This has implications for players and lotteries, where players risk the potential for retailer fraud and the loss of a ticket equates to a loss of rights. Also, lotteries have very limited data on the players.

Of these concerns, limiting the potential for retailer fraud has become paramount in recent years due to concerns raised primarily in Canada. As a response to this, lotteries have expanded distribution of check-a-ticket technology that provides players an opportunity to scan a game ticket prior to giving the game ticket to their retailer for validation. However, this technology is expensive and occasionally causes the player as many headaches as it resolves, due to messaging on the device and the consistency of read rates.

In most lottery games, the game ticket is a bearer instrument in which a loss of a winning ticket results in a loss of rights to the winnings. Accordingly, it becomes incumbent upon the player to retain their game ticket and ensure that their retailer validates their game ticket. Failure on the part of the player to take either of these actions results in a negative experience for the player, from what should be a positive one.

Also, as bearer instruments in most lottery games, game tickets provide very little player information. Play data is limited to the parameters supported either by the play-slip or via the terminal. As a result lotteries are limited to a combination of player club membership/2nd chance drawings, and claim files to ascertain any specific level of a player's preferences. As competing industries are finding creative ways to leverage technology to develop a more personal relationship with their customers, it has become critically important that lotteries pursue this goal as well.

Currently, most host lottery systems are designed in accordance with the needs of an anonymous player, and all lottery systems that operate by scanning play-slips at retail terminals follow the anonymous player model. Accordingly, systems' promotion modules limit administrators to define only narrow set of criteria by which promotions will be offered, such as promotions based on Every Nth Ticket, Buy X Tickets, and Time/Date (i.e. from 5 PM-7 PM on Fridays). For anonymous players, these criteria are paired with promotions that provide free plays, higher payouts, and entries. Such promotions can be offered system-wide. The only choice players have is whether or not they want to purchase the qualifying transaction.

SUMMARY OF THE INVENTION

The present invention is a platform that allows players the opportunity to personalize their lottery game ticket. Appending player information to a lottery transaction addresses a significant, ongoing challenge for lotteries, eliminating retailer fraud.

Once player information is included with the ticket purchase, a Lottery receives more specific information about their players' preferences. This provides unique marketing opportunities for the Lottery to create a more personal playing experience.

Additionally, the present invention utilizes a barcode for generating transactions which simplifies ticket processing for retailers, and, since bar code scanners require no moving parts, also reduces terminal wear for a technology provider.

Finally, with the present invention, the player-generated scanning-code (such as a barcode) will replace the play-slip, allowing a technology provider to experience a reduction in consumables expense.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
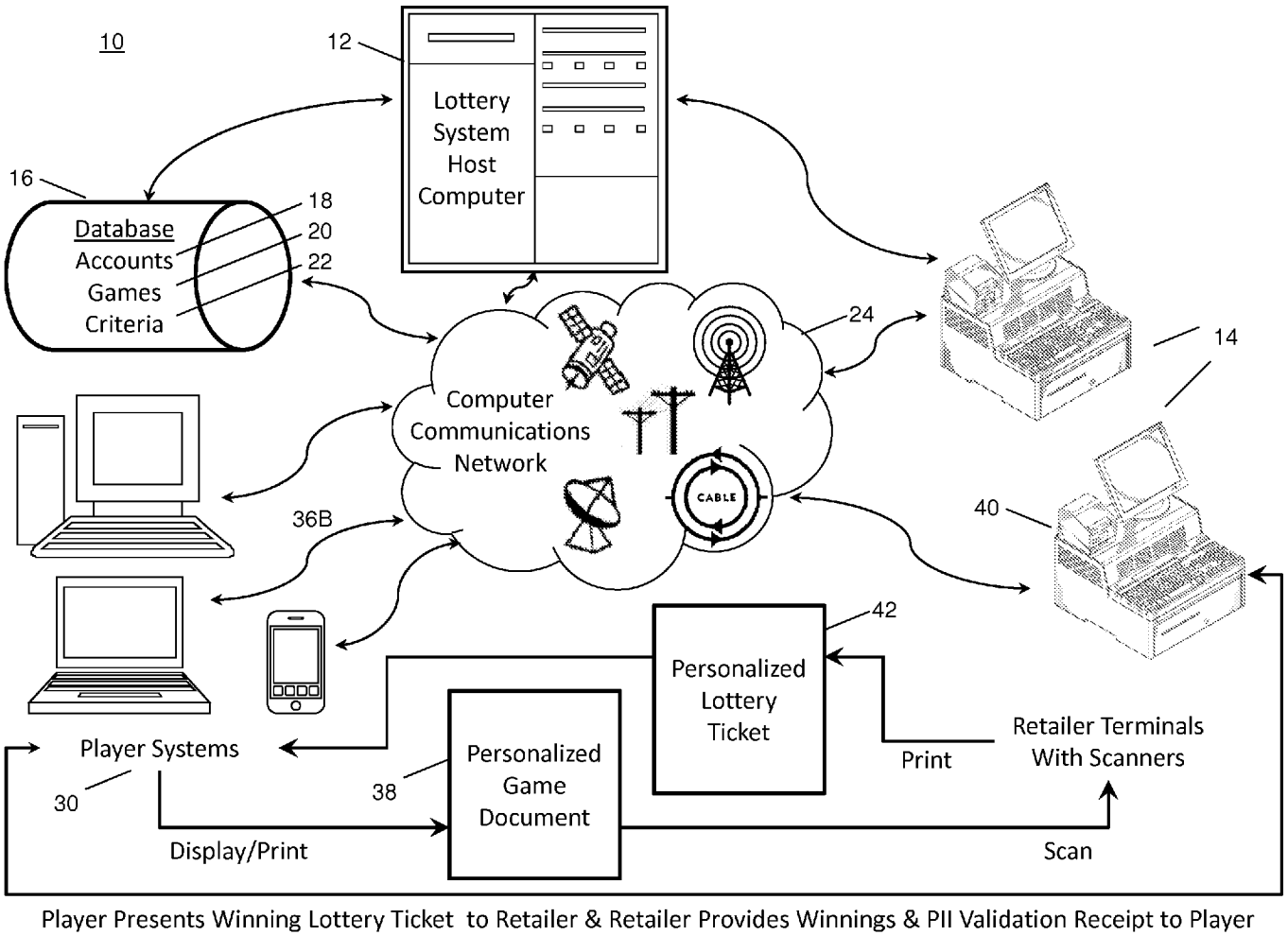
FIG. 1A is a system block diagram of the components used in the present invention.

The overall system 10 and process 100 of the present invention are described with reference to FIGS. 1A and 1B. Each of the steps in the process are particularly described with reference to additional illustrations to further explain the invention as set forth in the claims. Generally, the system and process establish ownership of a lottery game ticket and provide additional security and game options for lottery players and are referred to throughout this specification as the personal play system and process 10, 100.

A host computer 12 for the lottery system is in operative communication with a plurality of retailer terminals 14. An electronic database 16 contains player accounts 18, game options 20 and play criteria options 22 that are securely accessible through a computer communications network 24. The player accounts include player identifiable information (PII) 26, such as a player's name, and may also include a user ID or other player identification code 28. The players access their accounts on the database 16 as authorized players on their computer systems 30 via the computer network 24. The game options 32 and play criteria options 34 are defined according to the lottery system's rules of play. As discussed in detail below, the rules of play for the lottery system can be expanded to include additional options for authorized players with accounts managed within the database.

It will be appreciated that any type of computer communications network could be used to provide the users with access to their accounts, including computers that access the database through a webpage interface and smartphones that access the database through a specialty phone application. In either case, it is preferable to have a graphical interface 36A which has a communication link 36B to the system 10. The host computer may be in direct communication with the database which may be integrated within the lottery system's server or computer system.

As explained in detail below, the process to establish ownership of the lottery game ticket begins with an authorized player accessing their user account 18 in the personal play system 10 and creating a personalized game document 38 which contains both play data and player identifiable information (PII). The personalized game document 38 is scanned by an electronic scanner 40 of a retailer terminal 14 and the information is communicated to the lottery system's host computer 12 which logs the information and verifies that the transaction can be completed by the retailer terminal printing a personalized lottery ticket 42.

Figure 2:
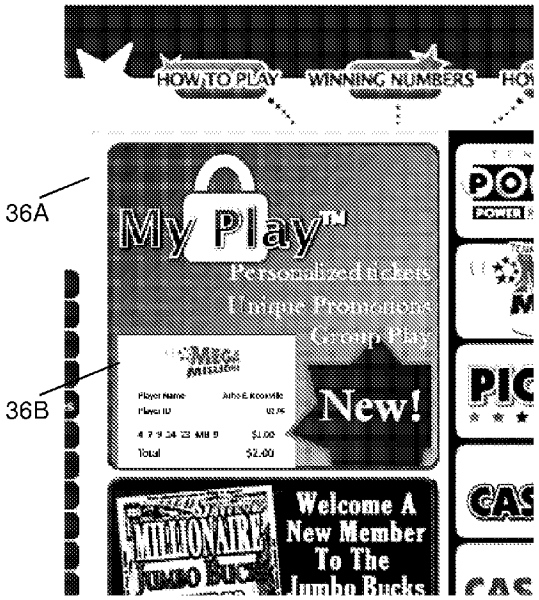
FIG. 2 is a section from a webpage providing game options.

A player can access their user account through a link to the personal play system. The link may be presented to players on the home page of a lottery's web site or it may be an application button on a smart phone. An example of a graphical interface 36 is shown in FIG. 2. Accordingly, it will be appreciated that the communication link to the system can be through a web interface or a smart phone application interface.

Figure 3:
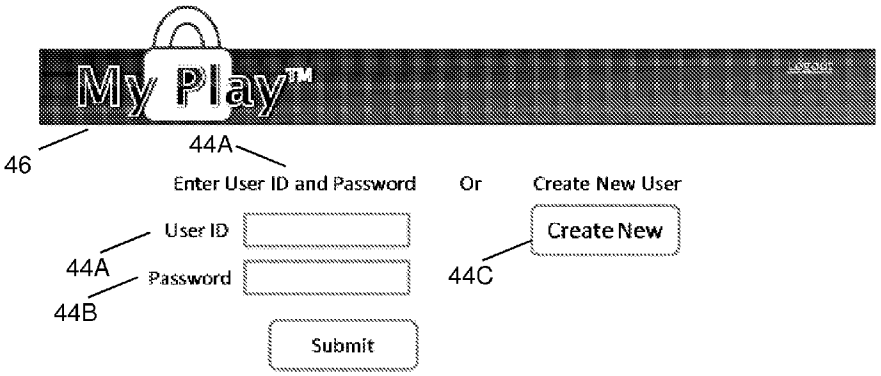
FIG. 3 is a login screen.
Figure 5:
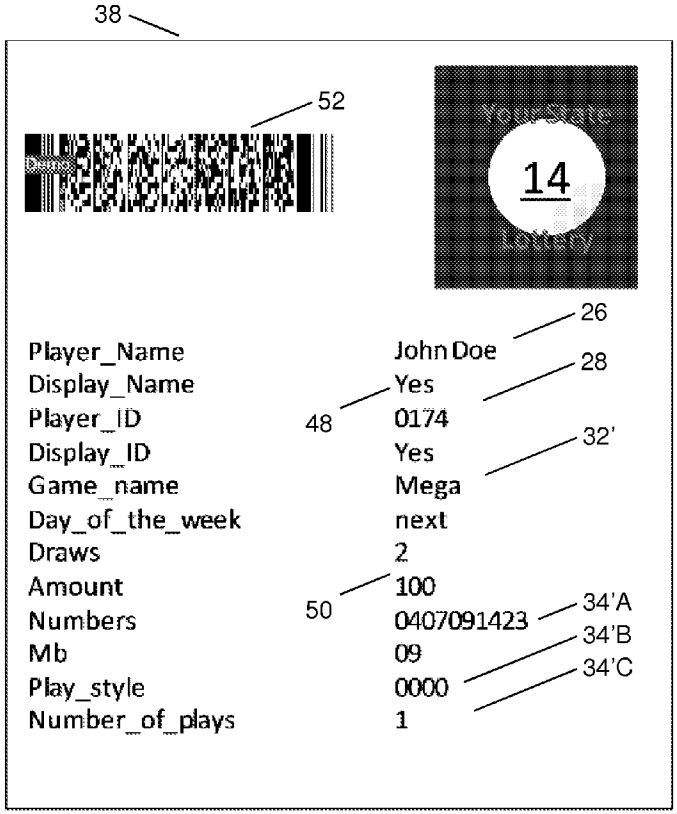
FIG. 5 is a view of a personalized game document according to the present invention.

The player accesses the personal play system through the communication link 110 and is prompted to enter login information 44, such as a user ID 44A and password 44B, on a login screen 46 as shown in FIG. 3. The player will either do so or, in the case of a player that has not utilized the personal play system service before, create a new user account 44C. As indicated above, the user accounts contain the player identifiable information (PII) and may include player preferences. For example, as shown in FIG. 5, one player preference could be a display-name option 48 in which the player can choose whether their name should be displayed on the personalized game document and the personalized lottery ticket or whether only the player ID should be shown. Once the player is signed in, they can begin the process of creating their personalized game document which can result in a personalized lottery ticket when the transaction is verified by the lottery system. Accordingly, in this manner, a player is authorized to securely access one of the player accounts in the electronic database through the computer communications network 120.

Figure 1B:
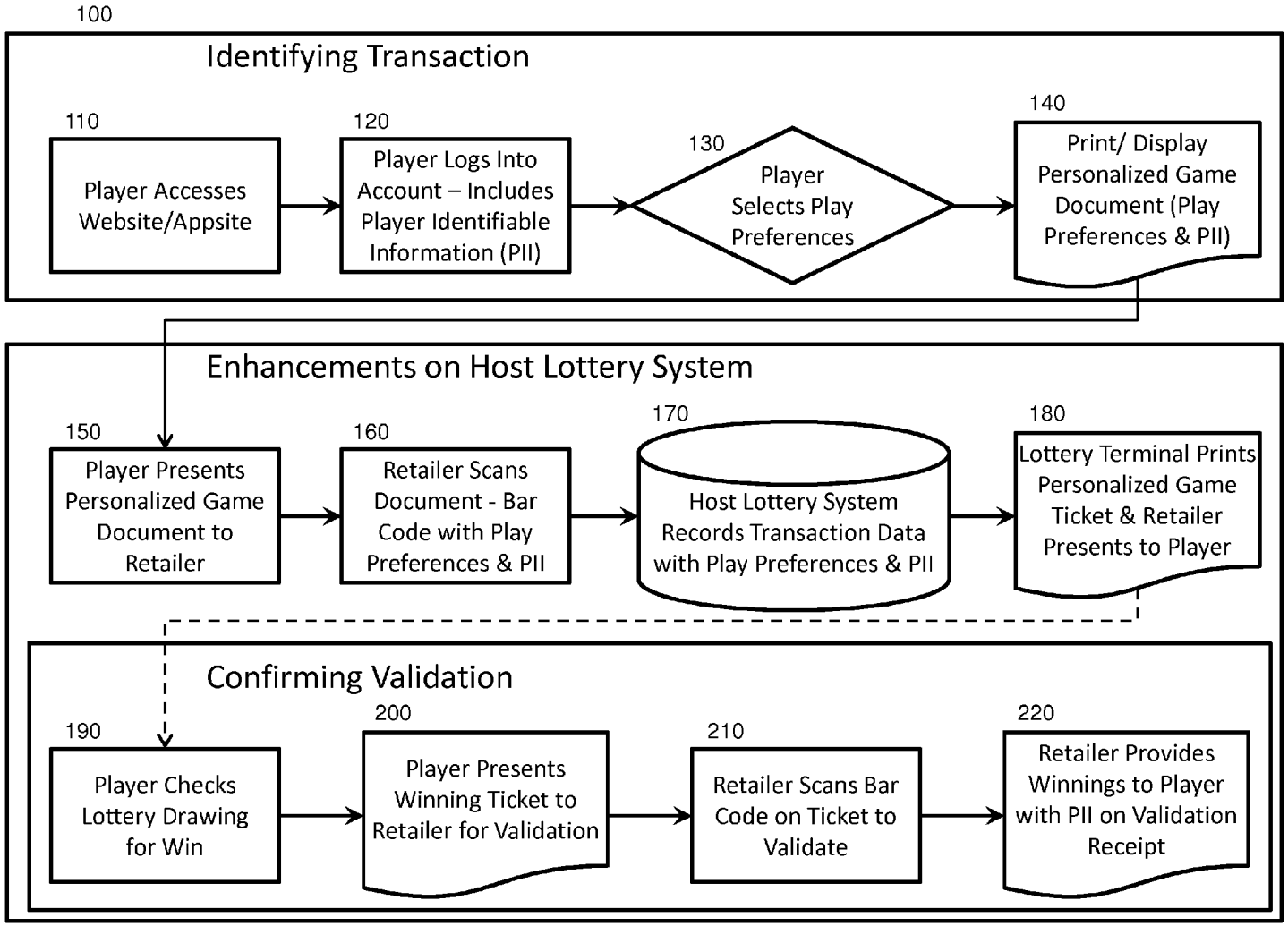
FIG. 1B is a flow chart of the overall process.
Figure 4:
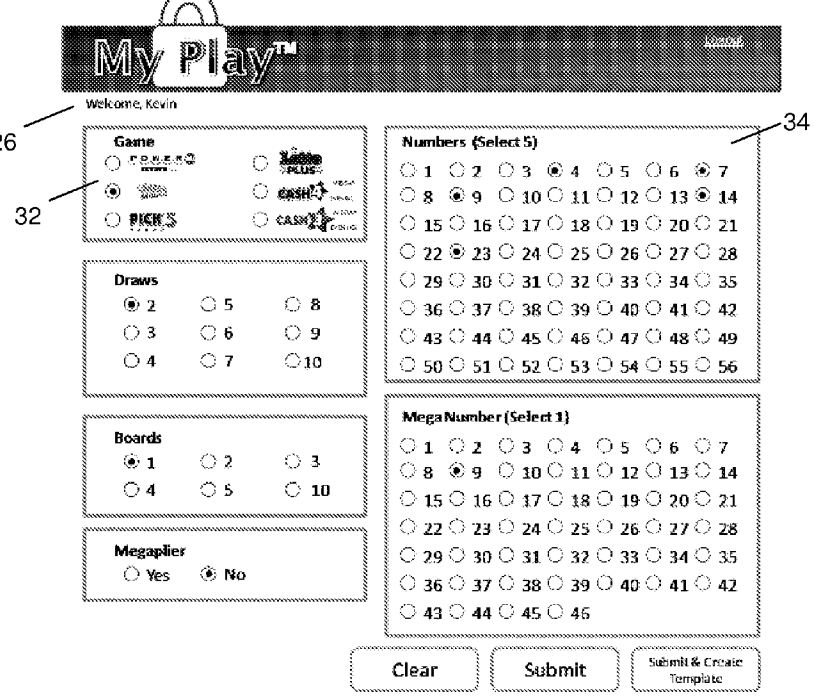
FIG. 4 is a screenshot of game options and play criteria options.

As indicated in the play preferences selection step 130 in FIG. 1B and shown in FIG. 4, when the player logs into their personal play system account, the site acknowledges the player by name 26 and presents the player with a set of game options 32. The player selects the game they would like to play, and the personal play system presents other play criteria 34 for which it needs player input. The player submits their selections for the play data 32', 34' once they have indicated their preferences, and the personal play system receives the play data from the authorized player through the computer communications network.

The personal play system uses the player's personal information 26, 28 and selected play data 32', 34' to create the unique personalized game document for the player. As shown in FIG. 5, the play data includes the game selection 32', the play criteria selections 34' and wager details 50. The game selection preferences may include numbers 34'A, play style 34'B, and number of plays 34'C such as shown for the selected game 32' (Mega, i.e., Mega Millions). The personal play system also generates a unique scanning-code 52 which defines all of the PII and the selected options for the particular play. The scanning-code can be a bar code or another type of scannable code, such as a data matrix, which is recognized by the electronic scanners at the retailer terminals. The personal play system creates the personalized game document with the PII, the play data and the scanning code. The player can print or otherwise display the personalized game document that is created by the personalized game system 140.

It will be appreciated that in many cases, the personalized game document would be printed by the authorized player and then brought to the participating retailer to be scanned. It will also be appreciated that the personalized game document can be maintained in its electronic form and either the display image can be scanned into the retailer terminal or the information could be transmitted directly into the retailer terminal, such as through a wireless connection. This would be most effective with a smart phone application although it is expected that tablet computers could also be used for this option. In either event, the personal play system transmits an electronic version of the personalized game document to the authorized player through the computer communications network.

The personal play system instructs the authorized player to present the personalized game document 38 to a participating retailer in order to process the unique data with the host lottery's computer system 12. The participating retailer is instructed to scan said personalized game document using the electronic scanners and to provide the authorized player with the personalized lottery ticket 42 which corresponds with the unique data on the personalized game document as it is interpreted by the host lottery's computer system. Accordingly, the player takes the personalized game document to the participating retailer for scanning at the lottery terminal 150. The terminal processes the information contained in the scanning-code and sends the corresponding data to the host lottery system 160. Since the player's personal information is included in the scanning-code, the scan provides this information to the host lottery system, and the host logs the play data along with the player's personal information and then sends a reply to the lottery terminal 170. Software programming for both the lottery terminal and the lottery's host system will interpret the data presented in the bar code, and the host system can store the additional data that can now be appended to a player's transaction. The personal play system logs the player identifiable information and the play data for the authorized player at the host lottery system as a recorded transaction.

Figure 6:
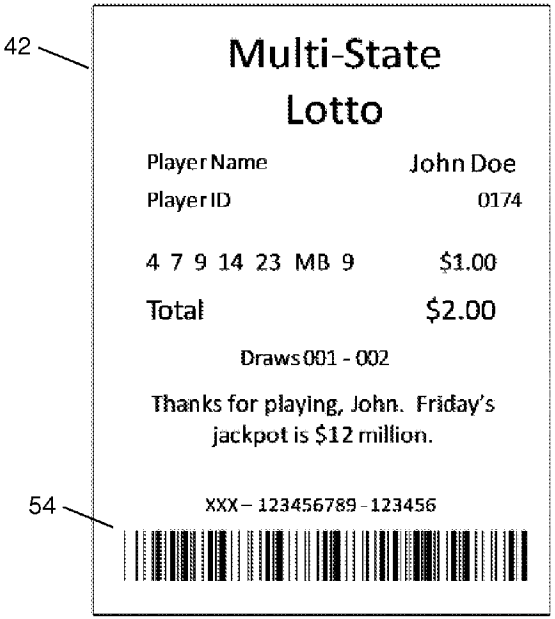
FIG. 6 is a view of a personalized lottery ticket according to the present invention.

The host system sends a verification report to the participating retailer's terminal to authorize the printing of the personalized lottery ticket for the recorded transaction. As indicated above, personalized lottery ticket includes the player identifiable information (or just the player code if desired) along with the play data corresponding with the unique data on the personalized game document. Once the participating retailer's terminal receives verification that the host has recorded the transaction, the terminal prints the personalized lottery ticket such as the one shown in FIG. 6 and the retailer presents the ticket to the player 180. Since the unique information is logged and stored on the lottery system, the personalized lottery ticket could be printed with a unique serial number 54 that corresponds with the stored information.

Figure 7:
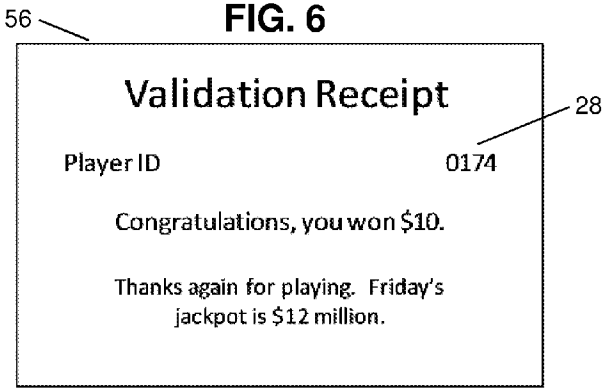
FIG. 7 is a view of a validation receipt for a winning ticket with personal player information.

Following the drawing, the player checks the numbers on their personalized lottery ticket to determine whether or not they have won 190. For a winning ticket, the player returns to the retailer to validate their ticket 200. The retailer scans the game ticket's code, and the host system validates that the serial number represents a winning ticket 210. In general, the host lottery system can receive any information that corresponds to a winning personalized lottery ticket. This information can be the unique serial number or it may be the same player identifiable information and play data that was on the personalized game document. The host lottery system authorizes the participating retailer to pay a winning amount with a validation receipt 56 which confirms the player identifiable information 220. An example of a validation receipt is shown in FIG. 7.

As indicated above, the retailer is authorized to pay the amount won to the player with the validation of the ticket by the host system. By having the retailer provide the player with the validation receipt, the lottery system confirms for the player that the ticket scanned was the player's ticket which gives the player a new level of fraud protection that anonymous lottery tickets cannot replicate.

The player has the ability to determine which of their personal information is available for presentation on both their ticket and their validation receipts. These determinants will be established when the player establishes their player profile through the web interface. In addition to their name, players will have the ability to specify a User ID. This alternative is offered to provide a code that the player will be able to quickly associate with their ticket or validation receipts. A code also offers a means of identification while maintaining the player's privacy. For the validation receipt shown in FIG. 7, the player selected the option in which the player ID 28 is displayed so the player's name does not appear.

There have been four major movements in the modern history of lotteries. Each of these movements has served as a building block for new products or services. The four generations are summarized below.

Generation 1: Passive Games/Instant tickets (1964-Present)

Generation 2: Online Systems/Draw Games/Lotto (Late 1970's-Present)

Generation 3: Enhanced Frequency/Social Games & VLTs (Late 1980's-Present)

Generation 4: Player-Centricity/Player Clubs (2000's-Present)

The industry is currently in the midst of migrating to a more player-centric experience. To date, this movement has been initiated by the emergence of player clubs, but the ultimate manifestation will be interactive gaming. While the legal status of interactive gaming for lotteries continues to be debated, there are certain opportunities available with the present invention that will allow a lottery to provide its players a more personal experience beyond that of the personalized ticket/validation receipt.

Personalizing the play experience through the present invention produces a number of marketing opportunities, including administration of group play, personalized prize structures—graduated prize structures, payout promotions for fixed prize games, time/draw sensitive promotions, cross-marketing promotions with other games, and eligibility for promotional drawings. Of these marketing opportunities, a few uniquely address issues never before addressed by the lottery industry.

The personalized play of the present invention permits the administration of group play. For high jackpot, lotto style games, players occasionally pool their wagers with other players to improve their odds of winning. These groups or syndicates are established with the understanding that winnings will either be split evenly or on a pro-rated basis in accordance with the amount each member contributes.

Some lotteries allow groups to register, but typically the groups are rather informally administered which result in a controversy for the lottery. When one of these groups wins, invariably a player that has participated with the group in the past claims, rightly or wrongly, that they were a member of the group for the drawing won. Generally this results in a lawsuit that in certain cases includes the selling lottery.

The present invention creates a platform from which group play can be administered. Since the transaction is identified, one of the data elements included in the bar code can be the group's name. Members of the group will be administered by the personal play system through the web site. For each week, only present members of the group will be logged as participating with the group.

The personalized play of the present invention also allows for personalized prize structures. In concert with the present invention (or other method for identifying a player), players could further personalize their lottery experience. The player's account could have a number of parameters. Included within those parameters could be prize structures for games. With current systems designed around an anonymous player, prize structures must be standardized. For example, a lottery might currently have a prize structure for a 3 digit, Keno wager as shown in the table below.

| Match | Standard Prize |
|---|---|
| 3 | $27 |
| 2 | $2 |
| 1 | $0 |
| 0 | $0 |

A uniquely identified player enables the ability to allow the player to choose or create a unique prize structure. Perhaps the player would prefer one of the optional prize structures shown in the table below instead of the standard prize structure above:

| Match | Prize Opt1 | Prize Opt 2 | Prize Opt 3 |
|---|---|---|---|
| 3 | $17 | $37 | $47 |
| 2 | $3 | $1 | $0 |
| 1 | $0 | $0 | $0 |
| 0 | $0 | $0 | $0 |

Each of the prize structures shown in the tables above, including the standard prize and the optional prizes, provides the same payout percentage (65.21%) while providing the player the ability to choose how that percentage is distributed amongst the various winning outcomes.

As a compliment to personalized prize structures, the present invention could also serve as a platform for graduated prize structures. A limitation of current lottery systems is that prizes are awarded as shares. For fixed-prize games that offer multiple-denomination wager options like Daily Numbers or Keno, this means that prizes will have a direct correlation to the amount wagered. Said differently, a fixed-prize game designed to pay 50% will pay 50% regardless of the amount wagered.

For years, lotteries' portfolios of instant tickets have included multiple price point games that feature higher payouts as the price point increases. Over time, instant tickets have become a significantly greater proportion of lotteries' sales in large part due to this value dynamic. Generally, this practice has increased overall return to state governments, despite a decrease in margins. For many lotteries, this practice has been fully optimized within the instant ticket portfolio. As a result, further increases to payout percentage for instant tickets could be deleterious to overall return.

Fixed-prize, draw-based games provide a new opportunity to improve the value of the lottery experience. Draw-based games typically provide lower payout relative to instant tickets, so driving participation to these games through graduated prizes will assist in generating more return for the state. A comparison of a current prize structure of a fixed-prize, draw-based game 58 and a graduated prize structure 60 for the same game are provided in FIGS. 8A and 8B, respectively. Accordingly, the current invention could serve as a platform for allowing not only personalized prize structures from the perspective of amount paid per outcome, but also in terms of payout percentage by price point for fixed-prize, draw-based games.

The other promotions referenced become unique when coupled with an identified ticket. As mentioned previously, systems are currently limited to establish qualifying determinants system-wide. With an personalized lottery ticket, promotions can become personalized as well.

An added benefit of a player utilizing the present invention (or a similar mechanism for identifying the player) is the ability to provide notices to that player. For example, as an option in the player's account, the player could be asked to provide an email address or mobile number so that the player can be notified when their identified play is determined to be a winner.

For a player utilizing the present invention (or similar mechanism for identifying the player), winning outcomes could be automatically applied to a player's bank account. As an option in the player's account, the player could specify a bank account that any winnings will be deposited in. In addition to directing winnings to a bank account, other parameters in a player's account could be configurable. It is possible that certain winning outcomes might have conditions applied to them. For instance, a configuration might specify that any winnings less than $3 be directed to an entity (i.e. charitable organization) on behalf of the player.

Figures 8A, 8B, 9:
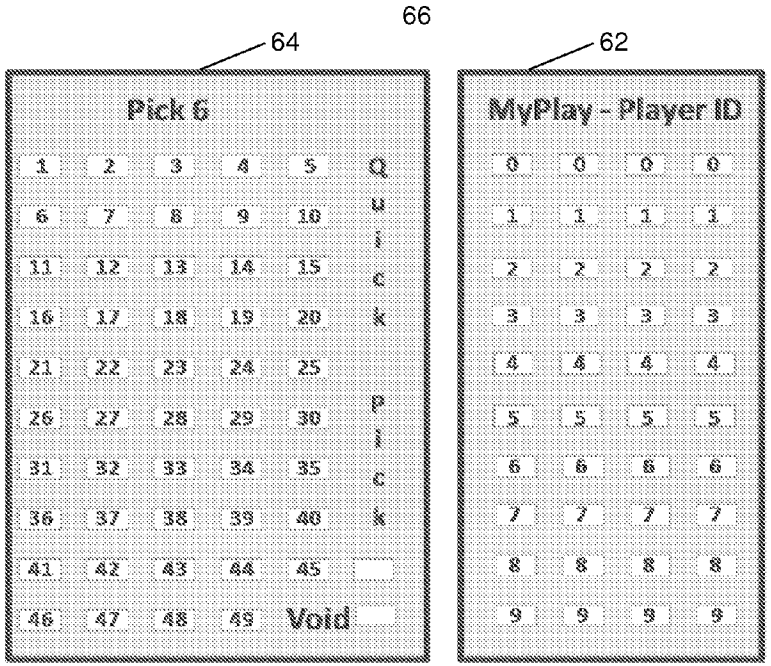
FIG. 8A Prior Art
FIG. 8A is a chart of a currently available prize structure.
FIG. 8B is a chart of a graduated prize structure according to the present invention.
FIG. 9 is a play-slip with a game playing field and a player identification field.

For players that do not have access to the internet, adding a player identification field 62 to the game playing field 64 on existing play-slips 66 provides the player a way to distinguish their ticket. For example, as shown in FIG. 9 with reference to a current Lotto ticket, four columns from 0-9 for identification purposes can be used on a play-slip. This is just one example of how this could be implemented. For example, any alpha-numeric character options could be used in the payer ID field. It will be appreciated that this field can take whatever form is necessary to fit within the available space on a particular play-slip. The important point to note is that the code provides a simple method of identifying the ticket and eventually the validation receipt, providing the player assurance that their ticket was processed appropriately. Since this method doesn't utilize the web interface, specifying the personal data that will be displayed is not an option. However, the code selected by the player will be displayed on both the ticket and the validation receipt.

Given the various communications options, it will be appreciated that any currently known communication system between computer systems and other communications devices can be used, including without limitation telephony, cable, fiber optic, cellular, satellite and any other wired or wireless communication system.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method for providing personalized plays in a host lottery system in operative communication with a plurality of electronic scanners at corresponding retailer terminals, comprising the steps of:

maintaining an electronic database of player accounts, game options and play criteria options securely accessible through a computer network, wherein said player accounts comprise player identifiable information, and wherein said game options and said play criteria options are defined according to the host lottery system;

presenting said game options and play criteria options to an authorized player through said computer network;

providing alternative prize structures in said play criteria options, wherein each one of said alternative prize structures comprises a plurality of price points, wherein said alternative prize structures are comprised of a plurality of optional prize structures selectable by a plurality of authorized players, wherein one of said authorized players selects one of said optional prize structures for a selected game and another of said authorized players selects another of said optional prize structures for said selected game, said alternative prize structures are comprised of sets of varying payouts for corresponding numbers of lottery matches;

receiving play data from said authorized player through said computer network, wherein said play data comprises a selection of said presented game options and corresponding play criteria options for said authorized player;

creating a personalized game document with unique data comprising said player identifiable information and said play data for said authorized player, wherein said unique data is formatted in a scanning-code recognizable to the electronic scanners at the retailer terminals;

identifying a selection of at least one of said alternative prize structures in said unique data for said authorized player; and transmitting an electronic version of said personalized game document to said authorized player through said computer network.

2. The method of claim 1, further comprising the step of instructing said authorized player to present said personalized game document to a participating retailer for processing said unique data with the host lottery system.

3. The method of claim 2, further comprising the step of instructing said participating retailer to scan said personalized game document using the electronic scanners and to provide said authorized player with a personalized lottery ticket corresponding with said unique data on said personalized game document as interpreted by the host lottery system.

4. The method of claim 2, further comprising the step of sending said player identifiable information and said play data for said authorized player to the host lottery system from the retailer terminal at said participating retailer.

5. The method of claim 4, further comprising the steps of:

logging said player identifiable information and said play data for said authorized player at the host lottery system as a recorded transaction; and sending a verification report to the retailer terminal of said participating retailer to authorize printing of a personalized lottery ticket for said recorded transaction, wherein said personalized lottery ticket comprises said player identifiable information and said play data corresponding with said unique data on said personalized game document.

6. The method of claim 1, further comprising the steps of:

receiving at the host lottery system information corresponding to a winning personalized lottery ticket; and authorizing said participating retailer to pay a winning amount with a validation receipt confirming said player identifiable information.

7. The method of claim 1, further comprising the step of providing software code to at least one of the host lottery system and the retailer terminals for interpreting said scanning-code of said unique data, wherein said software code resolves said scanning-code into said player identifiable information and said play data.

8. The method of claim 1, further comprising the step of providing at least one of a mobile phone application and a webpage interface for a plurality of players to securely access respective player accounts on said maintained electronic database.

9. The method of claim 1, further comprising the steps of:

administering a set of authorized players as a group, wherein said group has a defined name; and identifying said group with said group name in said unique data.

10. The method of claim 1, wherein said alternative prize structures are comprised of at least one of a non-standard distributed percentage and a graduated prize structure.

11. The method for claim 10, wherein each one of said sets of varying payouts combine to produce a substantially equal payout percentage for a set of winning tickets.

12. The method of claim 1, further comprising the step using said player identifiable information to provide a notification to said authorized player.

13. The method of claim 1, further comprising the step using said player identifiable information to distribute winnings of said authorized player.

14. The method of claim 1, further comprising the steps of:

providing a play-slip comprising a player identification field and a game playing field, wherein said player identification field comprises a plurality of alpha-numeric character options;

receiving said play-slip with selections made to said player identification field and said game playing field;

processing at the host lottery system said player identification field selections as a player code and said game playing field selections as said play data; and sending a verification report to the retailer terminal of said participating retailer to authorize printing of a partially-personalized lottery ticket for said recorded transaction, wherein said partially-personalized lottery ticket comprises said player code and said play data.

15. A method for providing personalized plays in a lottery system, comprising:

providing a host computer for the lottery system in operative communication with a plurality of retailer terminals;

maintaining an electronic database of player accounts, game options and play criteria options securely accessible through a computer network, wherein said player accounts comprise player identifiable information, and wherein said game options and said play criteria options are defined according to the lottery system;

authorizing a player to securely access one of said player accounts in said maintained electronic database through said computer network according to a user identifier and corresponding password;

presenting said game options and play criteria options to said authorized player through said computer network;

providing alternative prize structures in said play criteria options, wherein each one of said alternative prize structures comprises a plurality of price points, wherein said alternative prize structures are comprised of a plurality of optional prize structures selectable by a plurality of authorized players, wherein one of said authorized players selects one of said optional prize structures for a selected game and another of said authorized players selects another of said optional prize structures for said selected game, said alternative prize structures are comprised of sets of varying payouts for corresponding numbers of lottery matches;

receiving play data from said authorized player through said computer network, wherein said play data comprises a selection of said presented game options and corresponding play criteria options for said authorized player, wherein one of said play criteria options is comprised of any one of said alternative prize structures;

creating a personalized game document with unique data comprising said player identifiable information and said play data for said authorized player, wherein said unique data is formatted in a scanning-code recognizable to the electronic scanners at the retailer terminals; and transmitting an electronic version of said personalized game document to said authorized player through said computer network;

instructing said authorized player to present said personalized game document to a participating retailer for processing said unique data with the host lottery system;

receiving at the host lottery system said player identifiable information and said play data for said authorized player according to said unique data on said personalized game document presented to said participating retailer; and sending a verification report to the retailer terminal of said participating retailer to authorize printing of a personalized lottery ticket for said recorded transaction, wherein said personalized lottery ticket comprises said player identifiable information and said play data corresponding with said unique data on said personalized game document.

16. The method of claim 15, further comprising the steps of:

providing software code to the retailer terminals for interpreting said scanning-code of said unique data, wherein said software code resolves said scanning-code into said player identifiable information and said play data;

providing at least one of a mobile phone application and a webpage interface for a plurality of authorized players to securely access respective player accounts on said maintained electronic database; and wherein said alternative prize structures are comprised of at least one of a non-standard distributed percentage and a graduated prize structure.

17. The method of claim 15, further comprising the steps of:

administering a set of said authorized players as a group, wherein said group has a defined name identified in said unique data; and wherein each one of said sets of varying payouts combine to produce a substantially equal payout percentage for a set of winning tickets.

18. The method of claim 15, further comprising the steps of:

providing a play-slip with a player identification field in close proximity to a game playing field, wherein said player identification field comprises a plurality of alphanumeric character options;

receiving said play-slip with selections made to said player identification field and said game playing field;

processing at the host lottery system said player identification field selections as a player code and said game playing field selections as said play data; and sending a verification report to the retailer terminal of said participating retailer to authorize printing of a partially-personalized lottery ticket for said recorded transaction, wherein said partially-personalized lottery ticket comprises said player code and said play data.

19. A method for making personalized plays in a host lottery system in operative communication with a plurality of electronic scanners at corresponding retailer terminals, comprising:

accessing a player account in an electronic database by an authorized player through a computer network, wherein said database comprises a plurality of player accounts, game options and play criteria options, and wherein said player account comprises player identifiable information;

receiving a list of said game options and corresponding play criteria options from said electronic database;

presenting said game options and corresponding play criteria options to said authorized player through said computer network;

providing alternative prize structures in said play criteria options, wherein each one of said alternative prize structures comprises a plurality of price points, wherein said alternative prize structures are comprised of sets of varying payouts for corresponding numbers of lottery matches;

selecting a lottery game from said game options;

selecting play criteria by said authorized player corresponding to said selected lottery game, wherein one of said play criteria options is comprised of any one of said alternative prize structures as selected by said authorized player;

receiving a personalized game document with unique data comprising said player identifiable information, said selected lottery game and said selected play criteria;

presenting said personalized game document at a retailer terminal in said host lottery system; and receiving a printed personalized lottery ticket from said retailer terminal, wherein said printed personalized lottery ticket comprises said player identifiable information, selected lottery game and said selected play criteria corresponding with said unique data on said printed personalized game document.

20. The method of claim 19, further comprising the steps of:

determining said printed personalized lottery ticket is a winning ticket;

presenting said winning ticket to a participating retailer in said host lottery system for scanning at the retail terminal;

receiving winnings corresponding to said winning ticket, said selected one of said alternative prize structures and a validation receipt confirming said player identifiable information for said winning ticket, wherein each one of said sets of varying payouts combine to produce a substantially equal payout percentage for a set of winning tickets.

* * * * *